US005952912A

United States Patent [19]

Bauer et al.

[11] Patent Number: 5,952,912

[45] Date of Patent: Sep. 14, 1999

[54] ELECTRICAL ROTARY POTENTIOMETER

[75] Inventors: Karl-Heinz Bauer, Bad Neustadt; Reinhold Moret, Mellrichstadt; Ulrich Brueggemann, Heustreu, all of Germany

[73] Assignee: Preh-Werke GmbH & Co., KG, Bad Neustadt, Germany

[21] Appl. No.: 09/078,322

[22] Filed: May 14, 1998

[30] Foreign Application Priority Data

May 16, 1997 [DE] Germany ..... 197 20 543

[51] Int. Cl.[6] ..... H01C 10/32

[52] U.S. Cl. ..... 338/162; 338/160; 338/161

[58] Field of Search ..... 338/162, 157, 338/161, 160

[56] References Cited

U.S. PATENT DOCUMENTS

| | | | |
|---|---|---|---|
| 2,935,714 | 5/1960 | Barden et al. | 338/157 |
| 2,968,015 | 1/1961 | Blanco | 338/135 |
| 2,993,184 | 7/1961 | Mims et al. | 338/174 |
| 3,601,083 | 8/1971 | Stone | 116/115 |
| 4,032,880 | 6/1977 | Di Michele et al. | 338/157 |
| 4,069,466 | 1/1978 | Williams et al. | 338/147 |
| 4,771,262 | 9/1988 | Reuss | 338/162 |

FOREIGN PATENT DOCUMENTS

| | | |
|---|---|---|
| 36 31 056 A1 | 3/1988 | Germany . |
| 89 12 785 U1 | 2/1990 | Germany . |
| 97015 | 2/1993 | United Kingdom . |

*Primary Examiner*—Lincoln Donovan
*Assistant Examiner*—Richard Lee
*Attorney, Agent, or Firm*—Griffin, Butler, Whisenhunt & Szipl

[57] ABSTRACT

Rotary potentiometers known in the art having sensitive adjustment of the control knob require a stepdown gearing and have differing moments of friction that vary between devices. By contrast, in a rotary potentiometer of this invention a control knob (3) is mounted on at least three balls (6) that move, guided by a cage disk (7), in a housing groove (8) formed by a radial wall (9) and an axial wall (10), against which the balls (6) are urged by a load pressure of a conical bearing surface (11 or 12) of the control knob (3). The radial and axial wall bearing surfaces have contact and resistive strips (13, 14) that are short circuited by the balls (6). The control knob (3) has a stop lug (15) which contacts housing lugs (16) to limit a manipulation adjustment angle (4) and which, during operational adjustment, contacts at least one of two stop lugs (17) of the cage disk (7), which are positioned at an angle that corresponds approximately to one-half the manipulation adjustment angle (4) and the resistor tap angle (5). This design results in reduced cost and functional improvement.

5 Claims, 3 Drawing Sheets

ELECTRICAL ROTARY POTENTIOMETER

BACKGROUND OF THE INVENTION

This invention relates to an electrical rotary potentiometer having a rotary control knob mounted in a housing, a manipulation adjustment angle of which is larger than a resistor tap angle of the electrical rotary potentiometer.

German patent document (DE 36 31 056 A1), for example, discloses a rotary potentiometer having a resistive strip, wound in a main body, that is contacted by a tap member acting in a radial direction relative to a rotational axis.

In this rotary potentiometer, a moment of friction that occurs during rotation can be adjusted by a coaxial screw that screws into the main body to press against a rotating body. This screw serves various functions. It attaches the rotating body to the main body, it provides a necessary contact pressure for the desired moment of friction between the rotating body and the main body, and it provides mechanical mounting of the rotary potentiometer.

German patent document (DE 89 12 785 U1) discloses a tandem potentiometer in which a wiper is coupled via step-down gearing to a drive shaft such that a wiper, or tap, is adjusted by a smaller angle than an angle of the drive shaft. This makes possible a more sensitive adjustment of the potentiometer.

The step-down gearing includes a planet-wheel gear system, with the wiper referred to above being connected to a planet wheel located between gearing of the drive shaft and a stationary, concentric gear wheel.

It is an object of this invention to provide an inexpensively-produced rotary potentiometer having sensitive adjustment and an adjusting moment of friction that is substantially identical for each device made.

SUMMARY OF THE INVENTION

According to the principles of this invention, a rotary potentiometer has a rotary control knob mounted on at least three balls for movement in a housing groove formed by a radial wall and an axial wall, with a cage disk guiding movement of the balls. The balls are urged against the radial and axial walls by load pressure of a conical bearing surface of one of the housing and control knob. The radial and axial wall bearing surfaces have contact and resistive strips that are short circuited by the balls. The control knob has a knob stop lug for contacting housing lugs to limit a manipulation adjustment angle and which, during operational adjustment, contacts at least one of two disk stop lugs of the cage disk. The disk stop lugs are positioned at an angle that corresponds approximately to one-half of the manipulation adjustment angle and to a resistor tap angle.

BRIEF DESCRIPTION OF THE DRAWINGS

The invention is described and explained in more detail below using an embodiment shown in the drawings. The described and drawn features, in other embodiments of the invention, can be used individually or in preferred combinations. The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF THE PREFERRED EMBODIMENT

Figure 1:
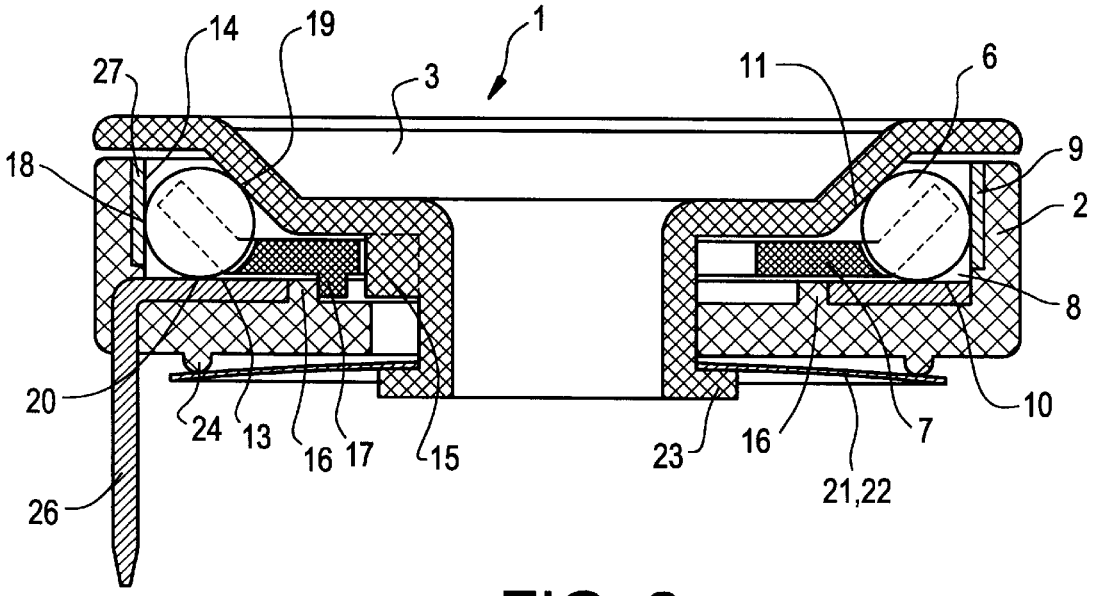
FIGS. 1 and 2 are side cross sections of two embodiments of a rotary potentiometers of the invention.
Figure 2:
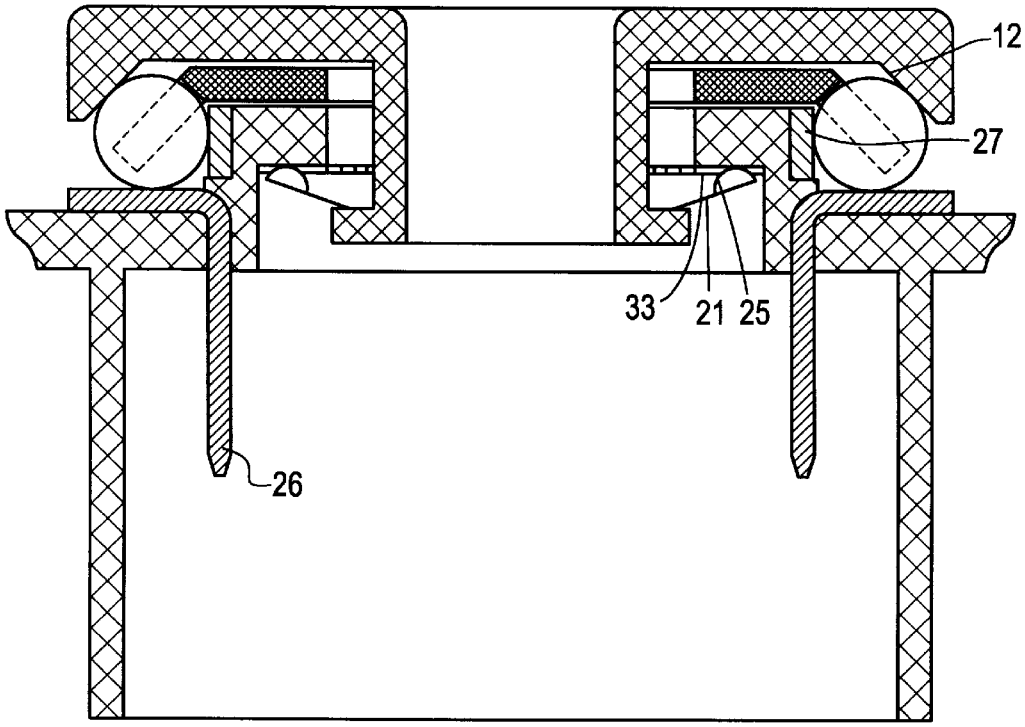

FIG. 1 shows a cross section of an electrical rotary potentiometer 1 having a control knob 3 mounted in a housing 2, a manipulation adjustment angle 4 (FIG. 3) of which is larger than a resistor tap angle 5, as is explained in further detail below with reference to FIG. 3. The control knob 3 is mounted on at least three balls 6 that move, guided by a cage disk 7, in a housing groove 8 formed by a radial wall 9 and an axial wall 10, against which the balls 6 are urged by a load pressure of an outward conical bearing surface 11 of the control knob 3. FIG. 2 shows an alternative embodiment in which an inward conical bearing surface 12 is provided. These two embodiments of the bearing make low-friction adjustment of the control knob 3 possible.

The radial and axial wall bearing surfaces have contact and resistive strips 13, 14 that are short circuited by the balls 6. The balls 6 are made of a highly conductive material and can be coated with a precious metal. In this manner, contact bridges, wipers, etc. used previously are now omitted, making this structure extraordinarily less expensive. The control knob 3 has a stop lug 15, the manipulation adjustment angle 4 of which is limited by housing lugs 16, as shown in FIG. 3. During operational adjustment, this stop lug 15 contacts at least one of two stop lugs 17 of the cage disk 7, which are positioned at an angle that corresponds approximately to one-half the manipulation adjustment angle 4 and to the resistor tap angle 5. A deviation of an actual ball-bearing-movement angle from a theoretically-possible angle, in a range of 100% to 50%, can be determined by experiment or by calculation. It has been shown that differently-sized circular lines traced by an engagement point of the outward conical bearing surface 11 with the balls 6 and a center point of the balls 6—or circular lines traced by an engagement point of the inward conical bearing surface 12 with the balls 6 and the center point of the balls 6—increase (approximately 100% to 55%) or decrease (approximately 100% to 38%) the ratio.

The invention is based on the realization that a ball or roller on which an object rolls, rolls at half the speed of the object, or moves only half the distance of the object. In this manner, in the structure of the rotary potentiometer 1 described above, a stepping-down of the operational adjustment of the control knob 3 to the movement of the balls 6, or the adjustment of the cage 7 that guides the balls, is achieved, without requiring gear wheels, for example.

It is known that in rolling bearings, a combined rolling and sliding type movement of the rolling bodies occurs, in which the sliding is characterized as microslippage. In the present rotary potentiometer 1, microslippage is intensified by differently-sized circular lines traced by ball bearing support points 18, 19 and 20, shown in FIG. 1, which are balanced out by sliding of the balls 6 on the contact and resistive strips 13, 14.

In this manner, self-wiping of the contact and resistive strips 13 and 14 takes place, which then makes it possible to use the balls 6 as short-circuiting transfer elements.

This microslippage, however, also means that the theoretically available step-down ratio is not maintained in certain circumstances. However, the stop lugs 17 on the cage disk 7 serve this purpose. These lugs ensure that the cage disk 7, and thus the balls 6, are always pulled along by the stop lug 15 of the control knob 3, to the housing lugs 16, i.e. a respective readjustment always takes place.

A load pressure of the outward or inward conical bearing surfaces 11 or 12 is created by one or more springs 21 mounted between the housing 2 and the control knob 3. For this purpose, in FIG. 1, a disc washer 22 is provided to serve as the spring 21 that is supported on a collar 23 of the control knob 3 and a stop collar 24 of the housing 2 when it is flexed into its installed position.

FIG. 2 shows an embodiment of the spring 21 with spring arms 25.

The embodiments shown in FIGS. 1 and 2 differ in their structures of outward and inward conical bearing surfaces 11, 12. FIG. 1 shows the design having an outward conical bearing surfaces 11, in which the radial wall 9 of the housing 2 faces inwardly, and FIG. 2 shows an inward conical bearing surfaces 12, in which the radial wall 9 points outward.

Figure 3:
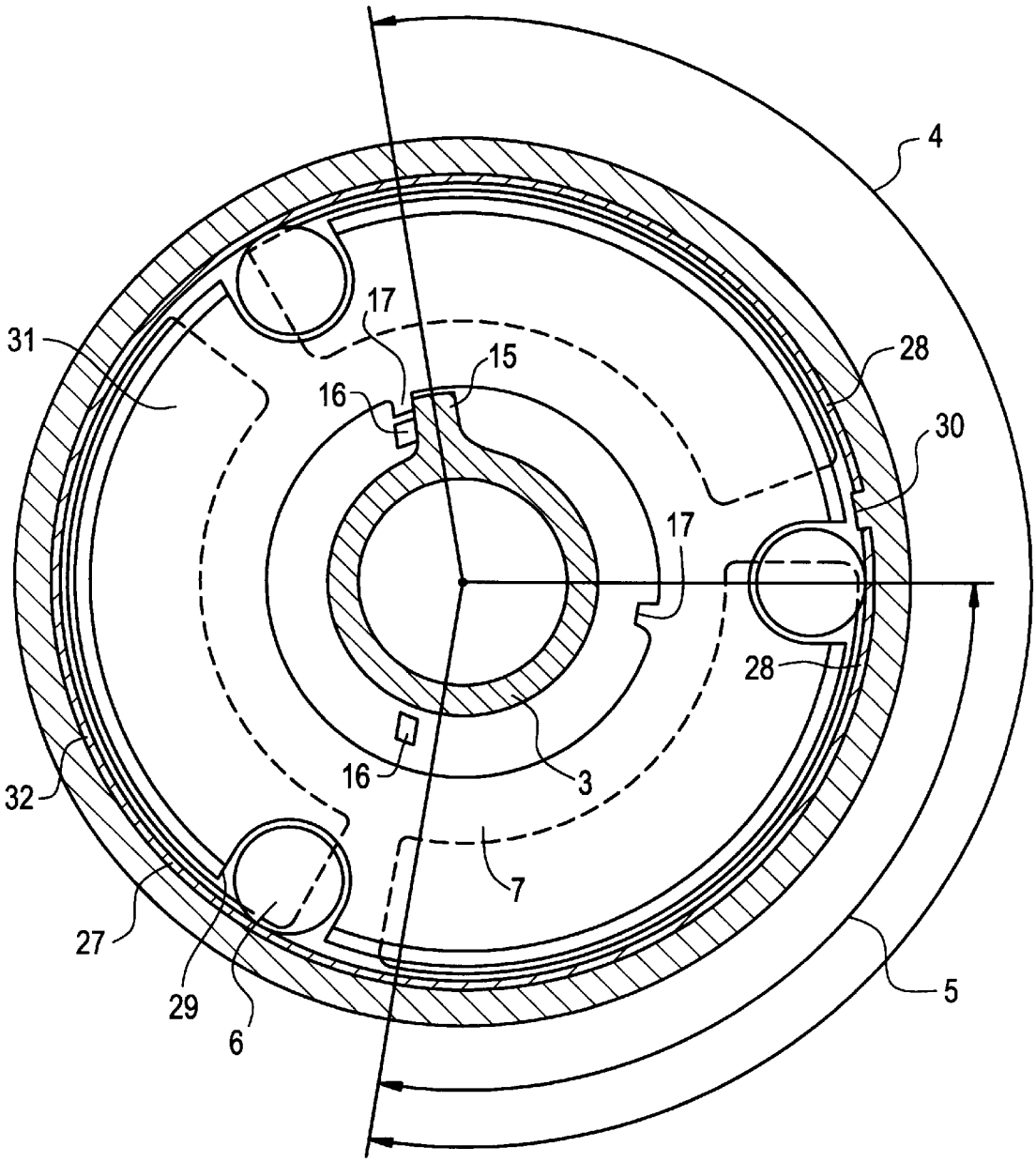
FIG. 3 is a top sectional view taken through the rotary potentiometer of FIG. 1.

It is provided that the contact strips 13 lead out of the housing 2 via terminal lugs 26, and the resistive strip 14 is comprised of a foil 27 laid in the housing 2, whose end sections 28 have a conducting layer, as shown in FIG. 3 (which is a cross section of FIG. 1 through the control knob 3 and the housing 2), with the balls 6 being shown inside guide recesses 29 of the cage disk 7, along with the manipulation adjustment angle 4 of the control knob 3 limited by the housing lugs 16 and the resistor tap angle 5 that corresponds approximately to one-half the manipulation adjustment angle 4, below which the stop lugs 17 of the cage disk 7 are arranged.

It is evident that, during an operational adjustment, as the stop lug 15 is moved away from one of the housing lug 16 in a direction of a stop lug 17 of the cage disk 7 and the other housing lug 16, this stop lug 17 of cage disk 7, which moves along at approximately half the speed, is caught by the stop lug 15 of the control knob 3 only when the stop lug 17 approaches or strikes the housing lug 16.

It is clear that the foil 27, in the embodiment shown in FIGS. 1 and 3, is positioned on the inward-facing wall of the housing, and is locked in position by a rib 30. In areas of contact segments 31 that form the contact strip 13 and to which the terminal lugs 26 mentioned above are electrically connected, the foil 27 has the conducting end sections 28 near the rib 30 and a resistive coat 32 forming the resistive strip 14 in a central section, so that contact results between each respective contact segment 31 and the conducting layer 28 and the resistive coat 32 via the balls 6 positioned between them, whereby a voltage tap between the resistive coat 32 and the contact segment 31 has a voltage level that is dependent upon position. The structure of the foil 27 in FIG. 2 corresponds to that in FIG. 1; however, measures for fastening and locking the foil in position are provided.

Advantageously the control knob 3 can have an indexing caused by, snap-in toothing or indication notches, 33 of the housing 2 or control knob 3, into which the spring arms 25 of the spring 21, positioned between the housing 2 and the control knob 3, engage, which provides position locking.

Terminal lugs 26 extending from the housing 2 make possible electrical connection of positive and negative poles of a voltage source with contact segments 31 which are linked to the layers at the end sections 28 of the foil 27. Via a terminal lug 26 of a contact segment 31 connected to the resistive coat 32 of the foil 27, a position-dependent voltage can be tapped between the positive and negative connections.

Figure 4:
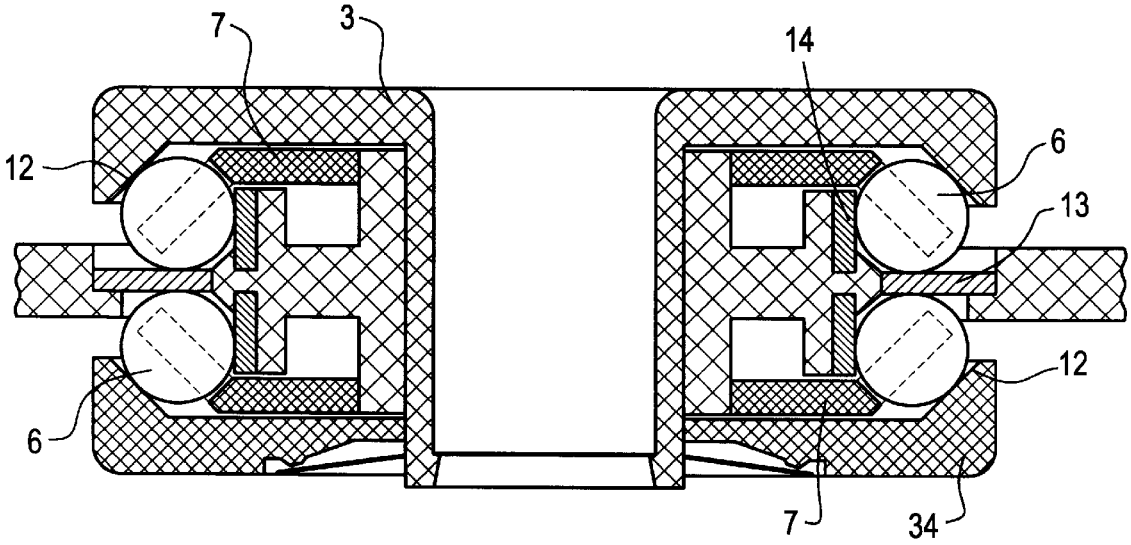
FIG. 4 is a side sectional view of a further embodiment of this invention.

FIG. 4 shows a further embodiment in which two-sided contacting occurs through balls 6 located on either side of the contact segment 13 and contact strips 14 and inward conical bearing surfaces 12, whereby one inward conical bearing surface 12 forms a closing ring 34 placed on a control knob 3. This embodiment makes a higher voltage or current load possible by doubling a contact area.

The invention is not limited to the embodiments presented; several balls and several resistive strips can be provided, without exceeding the scope of the invention.

The invention claimed is:

1. An electrical rotary potentiometer having: a housing; a rotary control knob mounted in the housing and rotatable relative to the housing, a manipulation adjustment angle of which is larger than a resistor tap angle of the electrical rotary potentiometer; at least three balls on which the control knob is supported for movement in a housing groove formed by a radial wall and an axial wall toward which the balls are urged by load pressure of a conical bearing surface of one of the housing and control knob; a cage disk for guiding movement of the balls; wherein the radial and axial wall bearing surfaces have contact segments and resistive strips that are short circuited by the balls, and wherein the control knob has at least one knob stop lug for contacting housing lugs to limit the manipulation adjustment angle and for, during operational adjustment, contacting at least one of two disk stop lugs of the cage disk, said disk stop lugs being positioned at an angle that corresponds approximately to one-half of the manipulation adjustment angle and a resistor tap angle.

2. An electrical rotary potentiometer as in claim 1, wherein the load pressure of the conical bearing surface is created by at least one spring mounted between the housing and the control knob.

3. An electrical rotary potentiometer as in claim 2, wherein one of the resistive strips and contact segments extend out from the housing via terminal lugs 26.

4. An electrical rotary potentiometer as in claim 3, wherein the resistive strip comprises a foil set in the housing, each end section of which has a conducting layer.

5. An electrical rotary potentiometer as in claim 2, wherein the control knob has an indexing means comprising indication notches on one of the housing and the control knob, with spring arms of the spring positioned between the housing and the control knob engaging therein.

* * * * *